United States Patent [19]

Zimmermann et al.

[11] 4,418,899

[45] Dec. 6, 1983

[54] PNEUMATICALLY DRIVEN CLAMPING DEVICE, IN PARTICULAR A MACHINE VICE

[75] Inventors: Hanns Zimmermann, Memmingen; Peter Preisenhammer, Kempten, both of Fed. Rep. of Germany

[73] Assignee: Saurer-Allma GmbH, Kempten, Fed. Rep. of Germany

[21] Appl. No.: 304,283

[22] Filed: Sep. 21, 1981

[30] Foreign Application Priority Data

Oct. 22, 1980 [DE] Fed. Rep. of Germany ..... 8028201

[51] Int. Cl.[3] ..... B25B 1/14

[52] U.S. Cl. ..... 269/32

[58] Field of Search ..... 269/32, 24, 234, 246; 91/401; 92/59, 13.8

[56] References Cited

U.S. PATENT DOCUMENTS

| | | | |
|---|---|---|---|
| 2,140,658 | 12/1938 | Van Sittert | 269/234 |
| 2,424,090 | 7/1947 | Gordinier | 269/234 |
| 2,530,085 | 11/1950 | Shaff | 269/32 |
| 2,803,157 | 8/1957 | Seitter | 269/32 |
| 3,484,094 | 12/1969 | Arnold | 269/32 |
| 3,941,362 | 3/1976 | Arnold et al. | 269/32 |
| 3,958,493 | 5/1976 | Fujita et al. | 92/13.8 |
| 4,354,421 | 10/1982 | Sims | 91/401 |

FOREIGN PATENT DOCUMENTS 2319686 11/1974 Fed. Rep. of Germany ..... 269/34

*Primary Examiner*—Robert C. Watson

*Attorney, Agent, or Firm*—Flynn, Thiel, Boutell & Tanis

[57] ABSTRACT

A pneumatically driven clamping device, in particular a machine vice, has a clamping member movable in the clamping direction in a stationary housing and an adjusting arrangement for coarse adjustment of the clamping member in the clamping direction with respect to the stationary housing. Between the adjusting arrangement and the clamping member in a drive housing there is provided a power amplifier with a primary element to which pneumatic pressure can be admitted, an abutment provided at one end of the power amplifier and connected to the adjusting arrangement, and a secondary element movable in the clamping direction at the other end of the power amplifier and acting on the clamping member. In the drive housing a wedge is provided which is movable transversely of the clamping direction of the power amplifier, is disposed between the secondary element of the power amplifier or its abutment and the respectively adjoining part to separate them in the clamping direction and is driven by a pneumatic piston and cylinder unit whose pressure chamber is connected in series with the pressure chamber of the primary drive element via a connecting duct and an adjustable excess-pressure valve arranged in this duct.

14 Claims, 2 Drawing Figures

COMPRESSED AIR
40

S
W
H
II
1
2
2a
3
4
5
5a
5b
6
7
7a
8
9
10
10a
11
12
13
14
15
16
17
17a
18
18a
19
20
21
22
23
24
24a
25
26
27
28
29

PNEUMATICALLY DRIVEN CLAMPING DEVICE, IN PARTICULAR A MACHINE VICE

FIELD OF THE INVENTION

The invention relates to a pneumatically driven clamping device, in particular a machine vice having a clamping member movable in the clamping direction in a stationary housing, an adjusting arrangement for coarse adjustment of the clamping member in the clamping direction with respect to the stationary housing, a power amplifier provided between the adjusting arrangement and the clamping member in a drive housing and with a primary element to which pneumatic pressure can be admitted, an abutment provided at one end of the power amplifier and connected to the adjusting arrangement, and a secondary element movable in the clamping direction at the other end of the power amplifier and acting on the clamping member.

BACKGROUND OF THE INVENTION

In power amplifiers of mechanical or mechanico-hydraulic type as employed in clamping devices of the above-described construction (see German Laid-open Patent Specification No. 23 46 771) the secondary element of the power amplifier performs a relatively short power stroke. This can be attributed to the power transmission ratio of the power amplifier. This short power stroke, which is only about 1 mm, is too small to be able to insert workpieces comfortably between, and remove them from, the clamping means. For this reason and so that the clamping means can also be used for workpieces of different sizes, an adjusting arrangement is provided in the known clamping device. This adjusting arrangement consists of an adjusting spindle screwable in a nut. The nut itself is adjustable stepwise in the stationary housing, while a continuous or infinitely variable fine adjustment can be carried out with the adjusting spindle. In order to shift the clamping member in the first place over a larger initial or starting distance (starting stroke) until it bears against the workpiece, it is necessary in the known clamping devices to turn the adjusting spindle. Apart from the fact that manual rotation of the adjusting spindle, in particular in mass production, is troublesome, there are not inconsiderable difficulties if it is desired to drive the adjusting spindle by motor in order to increase the starting stroke, i.e. the width of opening of the clamping device, in this way.

A clamping device with a power amplifier is also known (German Patent Specification No. 23 64 912) wherein the power amplifier is arranged in a housing movable in the stationary part of the clamping device. The powr amplifier is equipped with a primary plunger which can be pushed in at one end of the amplifier under the action of a push rod and with a secondary plunger emerging in the process in the same direction at the other end. Moreover, the clamping device has a mechanism having a retaining action on abutment of the clamping member against the workpiece and locking the housing containing the power amplifier with respect to the stationary part. If the movable housing with the power amplifier is to be moved until abutment occurs against the workpiece to be clamped, the locking mechanism must come into the retaining position precisely in that position in which the clamping member comes into abutment against the workpiece if the action of the power amplifier is to take full effect. Now if parts with a coarse tolerance, such as, for example, castings, are to be clamped, the supporting shoulder required for locking must be brought into such a position that the clamping device also still locks faultlessly in the case of the workpiece of largest size. In the case of parts of the smallest size, however, only part of the power stroke of the power amplifier then takes effect and, consequently, also only part of the clamping power thereof. This known clamping device is therefore only suitable for clamping mass-produced workpieces which show very small differences in size, such as, for example, pre-worked workpieces.

The problem underlying the invention is to provide a pneumatically driven clamping device, in particular a machine vice, of the kind mentioned at the beginning which has a relatively large opening stroke and ensures faultless clamping of mass-produced workpieces with larger differences in size with a clamping power of the same magnitude in each case.

SUMMARY OF THE INVENTION

According to the invention, this is achieved in that in the drive housing a wedge is provided which is movable transversely of the clamping direction of the power amplifier, is disposed between the secondary element of the power amplifier or its abutment and the respectively adjoining part to separate them in the clamping direction and is driven by a pneumatic piston and cylinder unit whose pressure chamber is connected in series with the pressure chamber of the primary element drive via a connecting duct and an adjustable excess-pressure valve arranged in this duct.

In the novel clamping device, a relatively large opening stroke is ensured by the wedge. This relatively large opening stroke renders possible the trouble-free insertion of mass-produced workpieces with larger tolerances in the clamping device. By means of the wedge driven by a pneumatic piston and cylinder unit, the clamping member is pressed against the workpiece inserted in the clamping device with an initial clamping force adjustable by means of the excess-pressure valve. After this initial clamping force has been reached, the excess-pressure valve opens, so that compressed air can enter the pressure chamber of that piston and cylinder unit which drives the primary element. In this way, the power amplifier is actuated with a power stroke which is dependent on the piston stroke. Since the power stroke always begins in the novel pneumatic clamping device only when the clamping member is already bearing against the workpiece, the workpiece is always clamped with a clamping force of the same magnitude irrespective of any workpiece tolerances. This clamping force can also be preset in addition by means of a suitable setting device which defines the piston stroke of the piston driving the power amplifier. It is also important in this case that the workpiece can be automatically clamped and released by actuation of a single valve. The manually operated adjusting arrangement is provided solely in order to be able to adjust or set the clamping device for clamping workpieces of other dimensions.

BRIEF DESCRIPTION OF THE DRAWINGS

The invention is described in detail hereinafter with reference to an embodiment shown in the drawing, in which:

FIG. 2 is a partial cross-section taken on the line II—II in FIG. 1.

DETAILED DESCRIPTION

Figure 1:
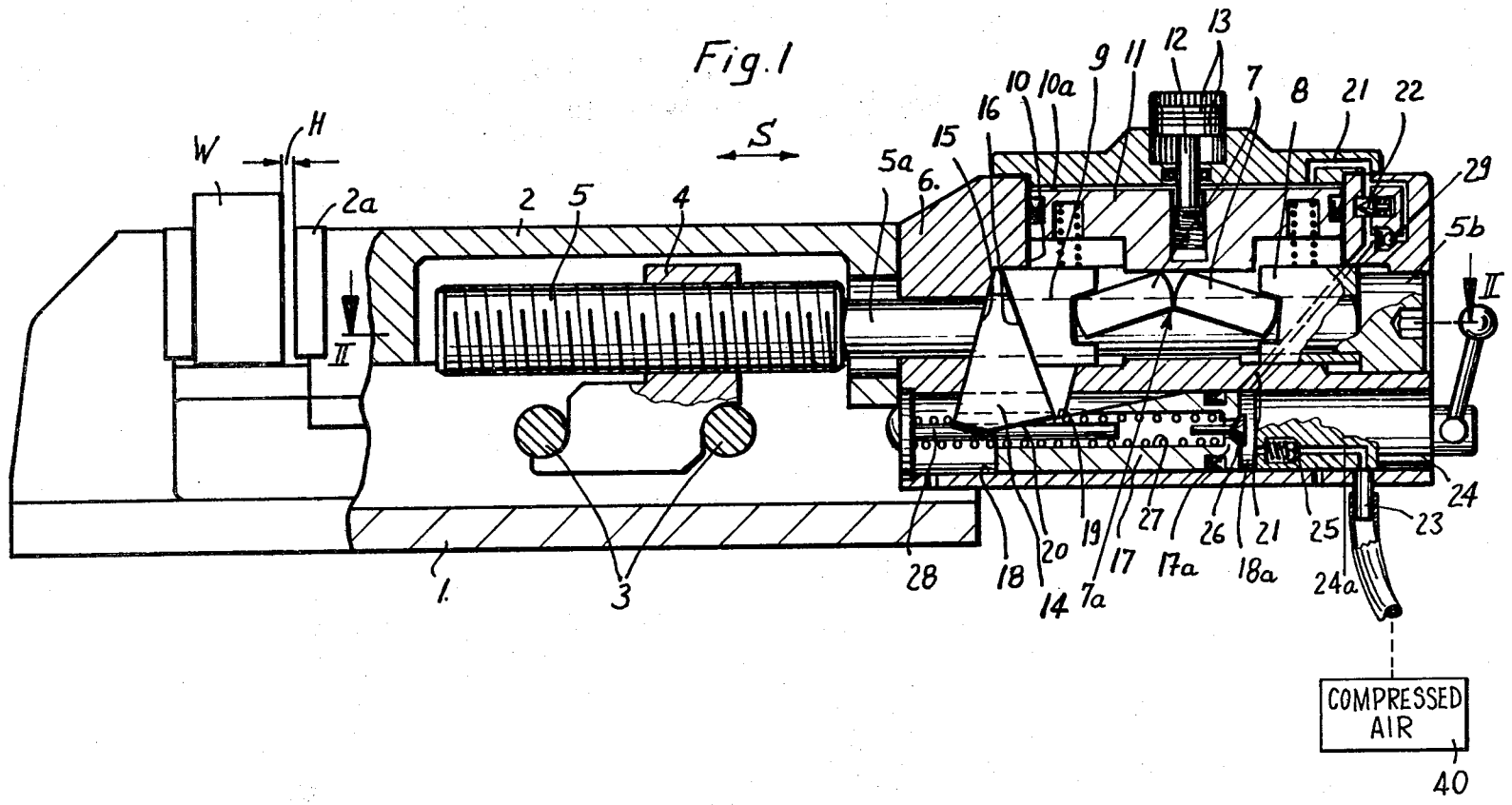
FIG. 1 is a longitudinal section through a clamping device embodying the invention.

The clamping member 2 is slideably supported in the stationary housing or base member 1 for movement in a clamping direction S. A nut 4 held between two cotter pins 3 can be adjusted stepwise in the clamping direction with respect to the housing 1 by rearranging the cotter pins 3. An adjusting spindle 5 is screwable in the nut 4 and its driving shank 5*a* is passed through the drive housing 6. The drive housing 6 is fixedly connected to the clamping member 2.

A mechanical power amplifier in the form of a toggle-lever power amplifier is provided in the drive housing. A pair of toggle levers 7 defines a toggle joint which is arranged parallel to the clamping direction S on one side of the driving shank 5*a*. A similar pair is provided on the other side of the driving shank 5*a*. One toggle lever of each pair of toggle levers is supported against an abutment 8, while the other toggle lever acts on a secondary element 9. A piston 11 movable in a cylinder 10 serves to drive the knee 7*a* of the toggle-lever power amplifier in a direction transverse to the clamping direction S. The idle position of this piston 11 is suitably definable by means of a setscrew 12, the head of which is provided with marking rings 13.

A wedge 14 movable transversely of the clamping direction S of the power amplifier 7–9 is moreover provided in the drive housing 6. This wedge 14 is disposed between the secondary element 9 and a wedge surface 15 on the drive housing 6. The secondary element 9 is also provided with a wedge surface 16. A piston 17 movable parallel to the clamping direction S and slidable in a cylinder 18 serves to drive the wedge 14. The piston 17 has a wedge surface 19 extending obliquely with respect to its axis, this wedge surface cooperating with another corresponding wedge surface 20 of the wedge 14. The angle which the surfaces 19,20 of the wedge 14 and the piston 17 enclose with the axis of the piston is advantageously smaller than the angle of friction, so that self-locking occurs between the wedge surfaces 19, 20 sliding one on the other.

In other words, the angle is sufficiently small so that leftward forces exerted on the piston 17 will produce minimal friction between the surfaces 19 and 20 and will produce a substantial leftward force component parallel to these surfaces which can overcome the friction and move the wedge 14 upwardly. On the other hand, downward forces exerted on the wedge 14 will produce a substantial amount of friction between the surfaces 19 and 20 and will produce only a small force component parallel to these surfaces which will be insufficient to overcome the frictional forces.

The pressure chamber 18*a* of the cylinder 18 is in communication with the pressure chamber 10*a* of the cylinder 10 via a connecting duct 21. An adjustable excess-pressure valve 22 is provided in this connecting duct 21. The pressure chambers 18*a* and 10*a* are connected in series via the connecting duct 21.

The drive housing 6 moreover has a compressed air connection piece 23 which communicates with a conventional source 40 of compressed air, and a rotary slide valve 24 for controlling the supply of compressed air. A non-return or check valve 25 is provided in the inlet duct 24*a* of the rotary slide valve 24. Furthermore, a safety valve 26 is arranged in the base 17*a* of the piston 17. The piston 17 has a central bore 27 in which a stationary pin 28 is engaged.

For clamping a batch of to some extent equal-sized workpieces W differing only by workpiece tolerances, by shifting the spindle nut 4 and turning the adjusting spindle 5 manually moves the clamping member into a position in which its clamping jaw 2*a* adopts a distance H of about 3 mm from the workpiece W. This distance H corresponds to the opening stroke of the clamping device. If the rotary slide valve 24 is now turned into the position of rotation shown in FIG. 1, compressed air can enter the pressure chamber 18*a*. As a result, the piston 17 is shifted to the left and its wedge surface 19 moves the wedge 14 upwardly transversely of the clamping direction S. The wedge 14 pushes the clamping member 2 to the left until its clamping jaw 2*a* comes into abutment against the workpiece W. During this process, the toggle levers 7 of the power amplifier remain in their inoperative position shown in the drawing. By means of the wedge 14, the clamping jaw 2*a* is pressed against the workpiece with a certain initial clamping force. As soon as the clamping jaw 2*a* bears against the workpiece W, the air pressure in the pressure chamber 18*a* increases until the initial clamping force is reached and the adjustable excess-pressure valve 22 then opens. The initial clamping force can be set by means of the excess-pressure valve 22.

When, after the initial clamping force has been reached, the valve 22 has opened the connecting duct 21, the actual power stroke begins. The compressed air flowing into the pressure chamber 10*a* moves the piston 11 downwardly and in so doing actuates the toggle levers 7 of the power amplifier. Since the power stroke always begins only when the clamping jaw 2*a* is bearing against the workpiece with a certain initial clamping force, the clamping force produced by the power amplifier is always of the same level irrespective of any workpiece tolerances.

However, in order to be able to adapt the clamping force produced by the power amplifier to the particular workpieces and exclude damage to a workpiece, the clamping force can be adjusted by means of the setscrew 12. This setscrew 12 can define the idle position of the piston 11. The particular setting of the setscrew 12 can easily be read off by means of the marking rings 13. By defining the idle position of the piston 11, its working stroke is reduced to a greater or lesser degree and the actual clamping force of the power amplifier can thereby also be adjusted.

The self-locking between the wedge surfaces 19, 20 prevents the wedge 14 yielding on actuation of the power amplifier. The non-return valve 25 ensures that the full clamping action of the clamping device is maintained even in the event of a drop in air pressure in the compressed air supply system.

The release and opening of the clamping device take place by turning the rotary slide valve 24 into a new position of rotation in which the pressure chamber 18*a* is in communication with the outside air via corresponding bores in the rotary slide valve and in the drive housing. The compressed air can now escape from the pressure chamber 10*a* via the connecting duct 21 and the non-return or check valve 29 into the pressure chamber 18*a* and from this chamber into the outside air. The parts 7 and 9 of the power amplifier, the piston 11 and also the piston 17 and the clamping member 2 are carried back into their initial positions by return springs. In the process, the clamping jaw 2*a* moves back from the workpiece W by the opening stroke H, so that the workpiece can now easily be removed. The opening stroke H is deliberately kept only of such a size that the workpieces of a batch can easily be inserted between the clamping jaws, but a finger does not fit between the inserted workpiece and the clamping jaws. There is therefore no risk of injury by pinching between the workpiece and the clamping jaws.

The safety valve 26 in the piston base 17*a* serves as a further safety precaution. If, in fact, the opening stroke H is adjusted too large, so that this stroke is greater than the stroke of the clamping member 2 which can actually be produced by the wedge 14, the piston 17 is then shifted so far to the left on actuation of the rotary slide valve 24 that the pin 28 opens the safety valve 26. Apart from the fact that in this way any further pressure build-up 8 in the pressure chamber 18*a* is avoided, and consequently actuation of the power amplifier, an acoustic signal is produced by the outflow of air and draws the operator's attention to the error of adjustment.

The invention is not intended to be limited to the embodiment illustrated. Instead of the mechanical power amplifier shown in the drawing, it is also possible to employ a mechanical power amplifier with a different construction or else a hydraulic power amplifier.

The embodiments of the invention in which an exclusive property or privilege is claimed are defined as follows:

1. A fluid actuated clamping device, comprising a base, a clamping member supported for movement relative to said base in a first direction and having a first surface thereon, an element supported for movement in said first direction independently of said base and clamping member and having a second surface thereon, a wedge supported for movement in a second direction transverse to said first direction and having third and fourth surfaces thereon which converge substantially in said second direction and which respectively slidably engage said first and second surfaces, first fluid actuated means for effecting movement of said wedge in said second direction, power amplifier means cooperable with said base and said element for causing movement of said element relative to said base in said first direction, second fluid actuated means for actuating said power amplifier means, means for selectively supplying a pressurized fluid to said first fluid actuated means, means defining a connecting duct for supplying said pressurized fluid from said first fluid actuated means to said second fluid actuated means, and excess pressure valve means disposed in said connecting duct for obstructing fluid flow therethrough until said pressurized fluid supplied to said first fluid actuated means exceeds a predetermined value.

2. The clamping device according to claim 1, wherein said first fluid actuated means includes a piston slidably supported in a cylinder for movement in a third direction transversely of said second direction, said piston having a fifth surface thereon which extends obliquely to said third direction and slidably engages a sixth surface which is provided on said wedge.

3. The clamping device according to claim 2, wherein the angle of said fifth and sixth surfaces with respect to said third direction is less than the angle of friction, whereby frictional self-locking is effected between said fifth and sixth surfaces in response to forces exerted on said piston in said second direction by said wedge.

4. The clamping device according to claim 2, wherein said piston has a bore therethrough, and including safety valve means for normally obstructing fluid flow through said bore, said safety valve means being opened when said piston is near one end of its path of travel by a stationary pin supported in said cylinder.

5. The clamping device according to claim 1, wherein said base includes adjusting means for effecting a coarse adjustment of the position of said base relative to said clamping member, said adjusting means including a nut provided on said base and a threaded adjusting spindle which extends substantially in said first direction and threadedly engages said nut, said power amplifier means cooperating with said base at a location on said adjusting spindle.

6. The clamping device according to claim 1, wherein said power amplifier means includes a toggle joint which extends approximately parallel to said first direction, the knee of said toggle joint being movable in a third direction transverse to said first direction, and wherein said second fluid actuated means includes a piston slidably supported in a cylinder for movement in said third direction and cooperable with the knee of said toggle joint for effecting movement thereof in said third direction.

7. The clamping device according to claim 6, wherein an idle position of said piston is adjustable and is controlled by a setscrew.

8. The clamping device according to claim 1, wherein said means for selectively supplying a pressurized fluid includes an inlet duct leading from a source of pressurized fluid to said first fluid actuated means, control valve means for selectively interrupting fluid flow through said inlet duct, and a check valve which is arranged in said inlet duct to prevent fluid flow in a direction from said first fluid actuated means to said source of pressurized fluid.

9. A clamping device, comprising first and second members supported for reciprocal movement in a first direction relative to each other, said first member having a first surface thereon and said first and second members each having a clamping jaw part thereon, said clamping jaw parts moving toward and away from each other in response to said reciprocal movement of said first and second members; an element supported for movement in said first direction independently of said first and second members and having a second surface thereon; a wedge supported between said first and second surfaces for reciprocal movement in a second direction transverse to said first direction, said wedge having third and fourth surfaces on opposite sides thereof which converge in said second direction and respectively slidably engage said first and second surfaces; means for effecting movement of said wedge in said second direction, which causes said first member to move away from said element and to move relative to said second member in a direction which causes movement of said clamping jaw parts toward each other; and selectively actuable power amplifier means cooperable with said element and said second member for effecting movement of said second member relative to said element and said first member in a direction which causes movement of said clamping jaw parts toward each other.

10. The clamping device according to claim 9, wherein said means for effecting movement of said wedge is fluid actuated and includes a first cylinder and a first piston reciprocally slidably supported therein for movement in a third direction generally transverse to said second direction, said first piston having a surface thereon which is inclined at a relatively small acute angle with respect to said third direction and said wedge having a surface thereon which slidably engages said surface on said first piston, and including means for selectively supplying pressurized fluid to said first cylinder on one side of said first piston.

11. The clamping device according to claim 10, including safety valve means for permitting fluid to escape from said first cylinder on said one side of said first piston when said first piston reaches a predetermined position along its path of travel.

12. The clamping device according to claim 10, wherein said power amplifier means includes a toggle joint extending generally parallel to said first direction, having one end supported on said element, and having the other end supported on said second member, the knee thereof being movable in a fourth direction transverse to said first direction, and wherein said power amplifier means is fluid actuated and includes a second cylinder and a second piston slidably supported therein for movement in said fourth direction and being operatively coupled to the knee of said toggle joint for effecting said movement thereof, including means defining a duct which provides fluid communication between said first cylinder on said one side of said first piston and said second cylinder on one side of said second piston, and including excess pressure valve means in said duct for obstructing fluid flow therethrough until the fluid pressure in said first cylinder on said one side of said first piston exceeds a predetermined value.

13. The clamping device according to claim 12, including an adjusting screw cooperable with said second piston for varying the position of said second piston when said second cylinder is free of fluid pressure.

14. The clamping device according to claim 12, wherein said second member includes a base part having the associated clamping jaw part and a nut thereon, and a threaded spindle extending substantially in said first direction and threadedly engaging said nut, said other end of said toggle joint being supported on said spindle.

* * * * *